US005575141A

United States Patent [19]

Genevray

[11] Patent Number: 5,575,141

[45] Date of Patent: Nov. 19, 1996

[54] PROCESS FOR BREAKING YARN FOR THE AUTOMATIC REMOVAL OF BOBBINS FROM BANKS OF SPINDLES AND PRESSER FINGER FOR PRACTICING THIS PROCESS

[75] Inventor: Henri Genevray, Guebwiller, France

[73] Assignee: N. Schlumberger et Cie (SA), Guebwiller, France

[21] Appl. No.: 501,816

[22] Filed: Jul. 13, 1995

[30] Foreign Application Priority Data

Jul. 13, 1994 [FR] France ..... 94 08883

[51] Int. Cl.[6] ..... D01H 9/14; B65H 54/00

[52] U.S. Cl. ..... 57/278; 57/267; 242/18 EW

[58] Field of Search ..... 242/18 EW; 57/115, 57/267, 269, 278, 299

[56] References Cited

U.S. PATENT DOCUMENTS

| | | | |
|---|---|---|---|
| 1,614,718 | 1/1927 | Colman et al. | 242/18 EW |
| 2,035,721 | 3/1936 | Reiners et al. | 242/18 EW |
| 3,019,590 | 2/1962 | Brame | 57/115 |
| 5,117,621 | 6/1992 | Feichtinger et al. | 57/278 |
| 5,331,799 | 7/1994 | Weeger | 57/278 |

FOREIGN PATENT DOCUMENTS

| | | |
|---|---|---|
| 0409755 | 1/1991 | European Pat. Off. . |
| 2665188 | 1/1992 | France . |

*Primary Examiner*—Michael R. Mansen
*Attorney, Agent, or Firm*—Young & Thompson

[57] ABSTRACT

A process for breaking yarn during the automatic removal of bobbins from banks of spindles, permitting the operator to grip the end of the yarn at the base of the bobbin (1) and guaranteeing good retention of the yarn during handling of the bobbin (1), thereby avoiding premature unwinding. There is also provided a presser finger for practicing this process, comprising a blade (5) having upper and lower heels (6 and 7) respectively upwardly and downwardly inclined from the plane of the blade. The process comprises, at the end of winding, stopping winding at the lower portion of the bobbin (1), then forming a lower winding of several turns about the base of the bobbin (1) and specifically about the core of the bobbin, then rising and effecting a limited upper winding followed by a descent and breaking of the yarn below the upper portion of the bobbin (1). Specifically, the upper winding is of about one-half turn about the core above the yarn wound on the bobbin. The invention is in the field of the textile industry, particularly concerning banks of spindles for long fibers.

3 Claims, 2 Drawing Sheets

PROCESS FOR BREAKING YARN FOR THE AUTOMATIC REMOVAL OF BOBBINS FROM BANKS OF SPINDLES AND PRESSER FINGER FOR PRACTICING THIS PROCESS

FIELD OF THE INVENTION

The present invention relates to the field of textile industry, particularly the banks of spindles for long fibers and especially the automatic removal adapted to remove from said banks full bobbins and replace them with empty bobbins, and has for its object a process for breaking the yarn for the automatic removal of the bobbins from the banks of spindles and a presser finger for practicing this process.

BACKGROUND OF THE INVENTION

At present, the banks of spindles for short fibers, such as cotton fibers, are generally provided with an automatic removal of the bobbins, the automatic removal operation being relatively easy, while on banks of spindles for long fibers this operation is much more difficult to perform.

Thus, to be able to effect the removal of full bobbins, it is necessary to break the yarn and moreover this latter must be broken at the outlet of the blade of the presser finger. This operation is performed without difficulty in the presence of short fibers, such as cotton fibers, the carriage bearing the full bobbins being simply given a descending movement after the stopping of the bobbins and the flyers. This descending movement has as a result the breakage of the yarn on each bobbin at the outlet of the blade of the presser finger, as desired.

In the case of long fibers, this maneuver does not permit absolutely obtaining the same result. The yarn of long fibers breaks in the tube of the flyer and not at the outlet of the blade of the presser finger, which has the effect that all automation is rendered useless. The rethreading of the whole machine is necessary each time.

Thus, the yarns of long fibers, namely whose fibers have a mean length comprised between 5 cm and 20 cm, do not always break at the same place and generally have a weak point at a place where the yarn is stretched.

Moreover, as the winding operation generally ends at the upper portion of the bobbin, it is necessary to obtain a correct winding of the end of the broken yarn so as to permit the transportation of said bobbin without risk of unwinding.

Finally, it is also necessary, so as to be able to restart automatically a new winding cycle, that the broken end of the yarn, at the level of the presser finger, should be completely available.

In FR-A-2 665 188 there has been proposed stopping the machine at a distance near the lower reversal at the end of winding, then putting into operation again the winding members of the bank of spindles and simultaneously lowering the carriage beyond the wound material. A winding of several turns is then effected on the upper end of the bobbin, then the yarn supply is stopped while effecting an overtwisting of this latter for several turns. A yarn reserve is then delivered and the carriage is raised, which breaks the yarn before a new descent of the carriage into the doffing position for automatic removal of the full bobbins.

The solution proposed by this document certainly permits effecting breaking of the yarn while ensuring that the end of the latter will be entirely wound on the bobbin and that the automatic restarting of a new cycle will be possible, but because the broken end is available relatively high on the bobbin, it poses a problem for the operators for the retrieval of the yarn end remaining on the full bobbin, when the latter is suspended from a rack.

OBJECTS OF THE INVENTION

The present invention has for its object to overcome these drawbacks.

It thus has for its object a process for breaking the yarn for the automatic removal of bobbins on banks of spindles characterized in that it consists essentially, at the end of winding, in stopping the winding in the lower part of the bobbin, then effecting a lower winding of several turns at the base of the bobbin, then rising and effecting a limited upper winding followed by a descent and breaking of the yarn below the upper portion of the bobbin.

The invention also has for its object a presser finger for practicing this process, characterized in that it comprises a blade provided with two respectively upper and lower heels.

BRIEF DESCRIPTION OF THE DRAWINGS

The invention will be better understood from the following description, which relates to a preferred embodiment, given by way of non-limiting example, and explained with reference to the accompanying schematic drawings, in which.

DESCRIPTION OF THE PREFERRED EMBODIMENT

Figure 3:
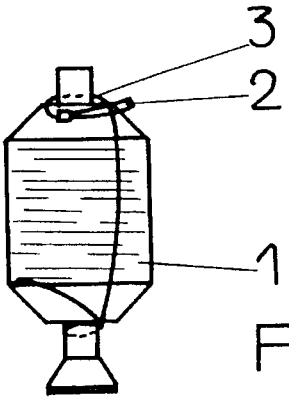
Figure 4:
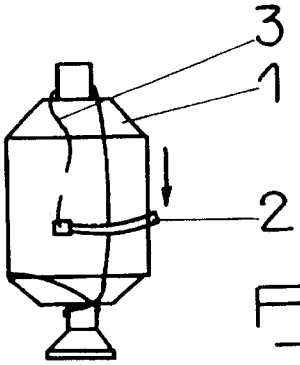

According to the invention and as shown more particularly in FIGS. 1 to 4 of the accompanying drawings, the process for breaking the yarn for the automatic removal of the bobbins 1 from the banks of spindles consists essentially, at the end of winding, in stopping the winding in the lower portion of the bobbin 1 (FIG. 1), in then effecting a lower winding of several turns at the base of the bobbin 1 (FIG. 2), then rising and effecting an upper limited winding (FIG. 3) followed by a descent and a breaking of the yarn below the upper portion of the bobbin 1 (FIG. 4).

This process permits the operator to grip the end of the yarn at the base of the bobbin 1 and guarantees good retention of the yarn during handling of the bobbin, thereby avoiding its untimely unwinding.

According to a characteristic of the invention, the upper winding, at the upper part of the bobbin 1, is effected over a length sufficient to ensure the maintenance of the yarn during handling of the bobbin but not too much, so as always to permit sliding of the yarn when pulled on.

Preferably, the upper winding, at the upper portion of the bobbin 1, is effected over a length corresponding to about one-half a turn about said bobbin 1.

Figure 1:
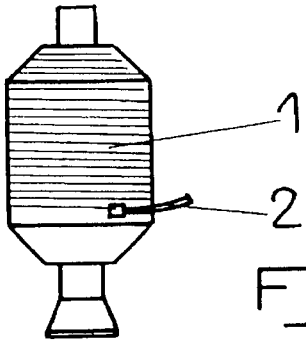
FIGS. 1 to 4 show in frontal elevation the various phases of the process according to the invention.
Figure 2:
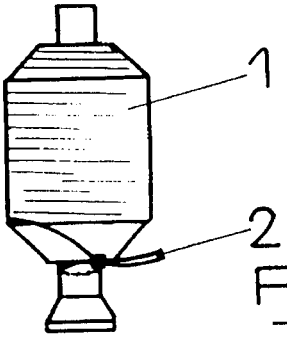
Figure 5:
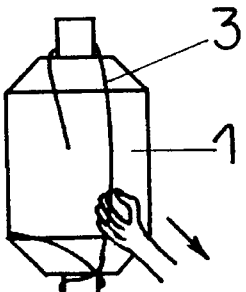
FIGS. 5 and 6 show, also in frontal elevation, on a larger scale, the manual gripping of the yarn in the lower portion of the bobbin.
Figure 6:
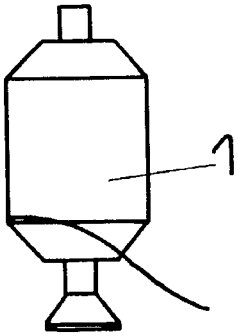

Thus, as shown in FIG. 5, the process according to the invention permits an arrangement of the yarn on the full bobbin in which the operator can seize the end of the yarn at the base of the bobbin when the bobbin 1 is hooked on the rack and bring it into the position shown in FIG. 6, even if the bobbin 1 is surrounded by other bobbins.

Moreover, the arrangement of the yarn according to the invention permits the handling of full bobbins, while avoiding the risk of unwinding because of the existence of a loop 3 about the upper portion of the bobbin 1 (FIGS. 3 to 5).

Figure 8:
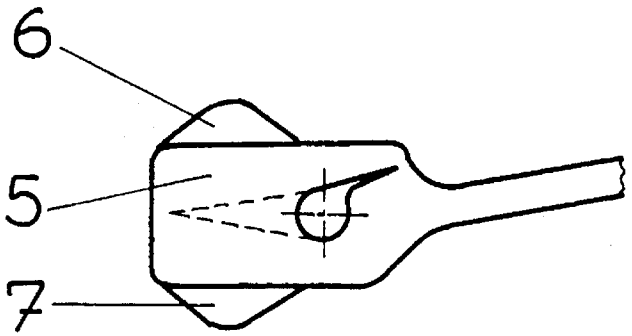
FIG. 8 is a side elevational view of the presser finger blade.
Figure 7:
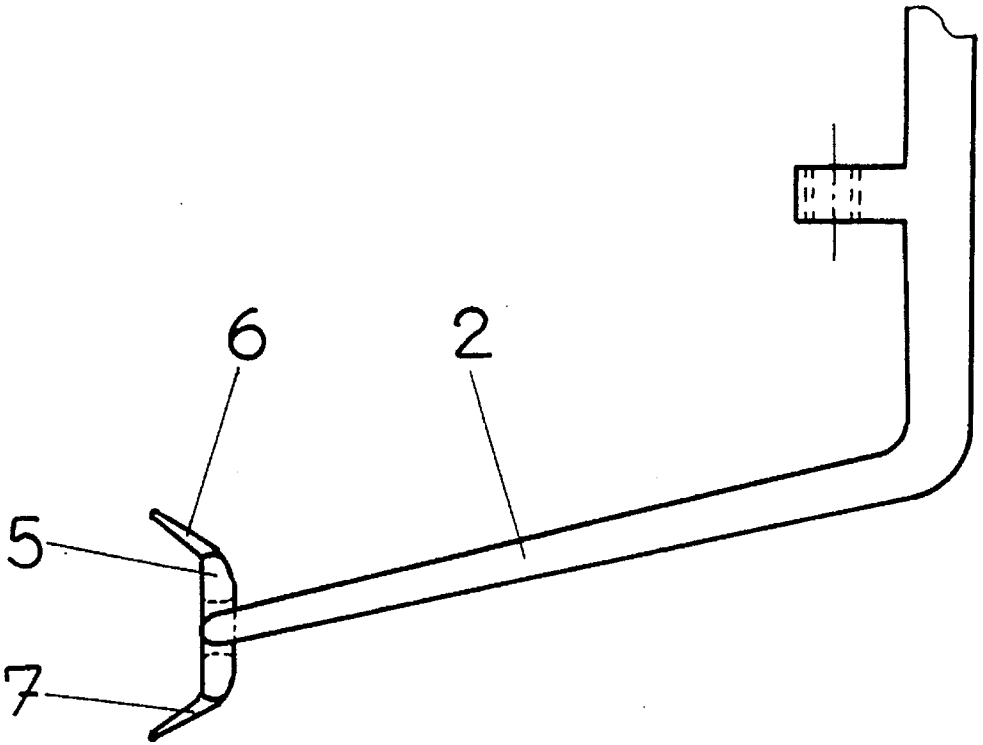
FIG. 7 is a fragmentary front elevational view of a presser finger for practicing the process according to the invention.

The invention also has for its object a presser finger 2 for practicing this process and adapted to position the yarn on the core to form the bobbin 1, which comprises an upper cone and a lower cone. To this end, as shown in FIGS. 7 and 8 of the accompanying drawings, the presser finger 2 comprises a blade 5 provided with two upper and lower heels, respectively 6 and 7, inclined respectively upwardly and downwardly. These heels 6 and 7 are adapted to permit the blade 5 to pass over the corresponding cones of the bobbin 1 toward the large base. Because of the process according to the invention, the blade 5 passes successively over the lower cone and then over the upper cone, which is facilitated by the upper and lower heels 6 and 7.

Thanks to the invention, it is possible to perform a cycle of yarn breaking permitting operators to grasp easily and with certainty the yarn, at the base of the full bobbin 1.

Of course, the invention is not limited to the embodiment described and shown in the accompanying drawings. Modifications remain possible, particularly as to the construction of the various elements or by substitution of technical equivalents, without thereby departing from the scope of protection of the invention.

I claim:

1. Process for breaking yarn for the automatic removal of bobbins (1) from banks of spindles, permitting the operator to grasp the end of the yarn at the base of the bobbin (1) and guaranteeing a good retention of the yarn during handling of the bobbin (1), thereby avoiding its untimely unwinding, comprising winding yarn on a substantially vertical bobbin, and at the end of winding, stopping the winding in the lower portion of the bobbin (1), then effecting a lower winding of several turns at the base of the bobbin (1), then effecting an upper limited winding at least partially about the upper portion of the bobbin followed by breaking of the yarn below the upper portion of the bobbin (1).

2. Process according to claim 1, wherein the upper winding in the upper portion of the bobbin (1) is effected over a length sufficient to ensure the maintenance of the yarn during handling of the bobbin (1) and to permit release of the yarn when traction is imposed thereon.

3. Process according to claim 1, wherein the upper winding about the upper portion of the bobbin (1) is effected over a length corresponding to about half a turn about said bobbin (1).

* * * * *